US010621957B2

(12) United States Patent
Schubert

(10) Patent No.: US 10,621,957 B2
(45) Date of Patent: Apr. 14, 2020

(54) PIANO PEDAL ACTUATING DEVICE AND METHOD OF PLAYING A PIANO USING THE DEVICE

(71) Applicant: Rose M. Schubert, Joliet, IL (US)

(72) Inventor: Rose M. Schubert, Joliet, IL (US)

( * ) Notice: Subject to any disclaimer, the term of this patent is extended or adjusted under 35 U.S.C. 154(b) by 0 days.

(21) Appl. No.: 16/558,984

(22) Filed: Sep. 3, 2019

(65) Prior Publication Data

US 2019/0392789 A1 Dec. 26, 2019

Related U.S. Application Data

(63) Continuation-in-part of application No. 15/619,250, filed on Jun. 9, 2017, now abandoned.

(60) Provisional application No. 62/355,240, filed on Jun. 27, 2016.

(51) Int. Cl.
*G10C 3/26* (2019.01)
*G10C 3/166* (2019.01)

(52) U.S. Cl.
CPC ..... *G10C 3/26* (2013.01); *G10C 3/166* (2013.01)

(58) Field of Classification Search
CPC ..... G10C 3/26; G10C 3/166
See application file for complete search history.

(56) References Cited

U.S. PATENT DOCUMENTS 7,355,109 B2 * 4/2008 Muramatsu ..... G10F 3/00 84/107

* cited by examiner

*Primary Examiner* — Kimberly R Lockett
(74) *Attorney, Agent, or Firm* — Wood, Phillips, Katz, Clark & Mortimer

(57) ABSTRACT

The combination of a piano and an actuating device for a pedal on the piano. The actuating device has a frame, an arm on the frame movable in a controlled path, and an actuator assembly. The actuator assembly has a component moved from a first position into a second position to thereby cause the pedal to move from the starting position into the actuated position. The actuator assembly is configured so that movement of the arm in a first direction in the controlled path causes the one component to move from the first position into the second position. The arm is movable by a leg of a user situated in a playing position with respect to the piano.

20 Claims, 10 Drawing Sheets

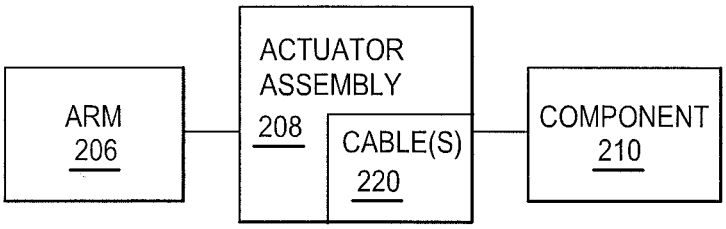
Fig. 10
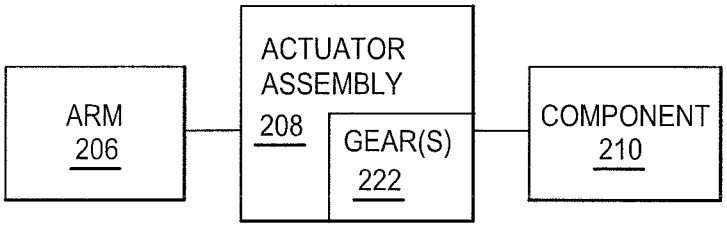
Fig. 11
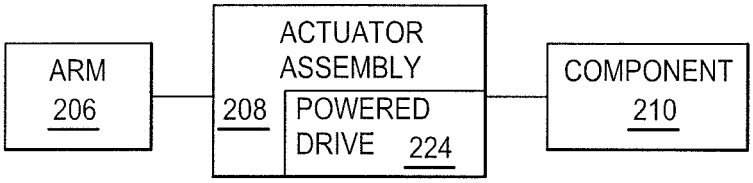
Fig. 12
Fig. 13
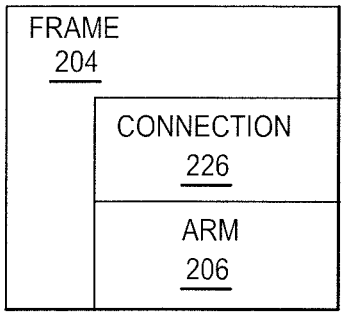

PIANO PEDAL ACTUATING DEVICE AND METHOD OF PLAYING A PIANO USING THE DEVICE

CROSS-REFERENCE TO RELATED APPLICATIONS

This application is a continuation-in-part of U.S. Ser. No. 15/619,250, filed Jun. 9, 2017, and claims the benefit of U.S. Provisional Ser. No. 62/355,240, filed Jun. 27, 2016, which are hereby incorporated by reference in their entireties.

FEDERALLY SPONSORED RESEARCH OR DEVELOPMENT

Not Applicable.

MICROFICHE/COPYRIGHT REFERENCE

Not Applicable.

BACKGROUND OF THE INVENTION

Field of the Invention

The present invention relates to a device for assisting a user to actuate/depress a piano pedal. More particularly, the invention relates to a piano pedal depressing device that can be used to engage a piano pedal by movement of a user's upper leg.

Description of the Related Art

Conventional pianos include pedals which are foot-operated levers located at the base of a piano. Most pianos are equipped with three pedals, a soft pedal (or una corda), a sostenuto pedal, and a sustaining pedal (or damper pedal). The piano pedals change the instrument's sound, enabling the user to achieve a desired sound when playing the piano. The damper pedal (which in general is the rightmost pedal) is the most frequently used of all pedals, and is also the most essential to playing certain pieces or arrangements. One disadvantage of the pedal's location at the base of the piano is that users with shorter legs, or users with a handicap, may be unable to engage and depress the damper pedal. As such, these users cannot make full use of the piano.

Accordingly, there exists a need for an apparatus that permits a handicapped person, or a person with relatively short legs (such as a child), to engage and actuate/depress the damper pedal of a piano or keyboard using his or her thigh or knee. Thus, a piano pedal actuating/depressing device solving the aforementioned problems is desired.

SUMMARY OF THE INVENTION

The piano pedal depressing device allows a user to depress a piano pedal using his or her upper leg, e.g., knee or thigh. In one form, the piano pedal depressing device is a portable, adjustable accessory that can be detachably connected to a piano. In one form, the device has a support frame/housing configured for positioning between a keyboard and a support surface, an actuator assembly on the housing, and a swivel arm extending from the housing and connected to the actuator assembly. The housing has a plurality of sidewalls, a base, and an upper compressible member for securely positioning the piano pedal depressing device between a piano and a support surface. The actuator assembly has an elongate shaft for selectively contacting the piano pedal. Movement of the swivel arm, initiated by the user, can cause the shaft to depress the piano pedal.

In one form, the invention is directed to the combination of a piano and a pedal actuating device. The piano has at least one operating pedal that is movable by a user from a starting position into an actuated position. The pedal actuating device has a frame, an arm on the frame that is movable in a controlled path, and an actuator assembly. The frame is in an operative position relative to the piano. The actuator assembly has a component that is moved from a first position into a second position to thereby cause the one operating pedal to move from the starting position into the actuated position. The actuator assembly is configured so that movement of the arm in a first direction in at least a part of the controlled path causes the one component to move from the first position into the second position. The arm is movable by a leg of a user situated in a playing position with respect to the piano by engaging a surface, that is movable with the arm, and moving the surface in a path that is substantially parallel to a horizontal reference plane.

In one form, the arm is movable around a vertical axis in the controlled path.

In one form, the component is a shaft that is guided in a substantially straight line between the first and second positions.

In one form, the arm has a main body and a user engagement assembly defining the surface. The user engagement assembly is repositioned relative to the main body to allow the surface to be repositioned relative to a user in a playing position.

In one form, the frame in the operative position is stabilized directly against the piano.

The frame in the operative position may be maintained in the operative position independently of the piano.

In one form, movement of the arm in the first direction in the at least part of the controlled path by a user generates a force that is transmitted to the one component through at least one of: (a) a cable; and (b) a cooperating pair of gears.

In one form, with the frame in the operative position, the one component is biased relative to the frame and into the first position.

In one form, with the frame in the operative position, the surface is situated to engage a user's body region between the user's calf and thigh with the user in a playing position with respect to the piano.

In one form, with the frame in the operative position, the surface is situated to engage a user's inner thigh on the user's right leg with the user in a playing position with respect to the piano.

In one form, with the frame in the operative position, the pedal actuated device may be compressibly captively maintained against a part of the piano.

The pedal actuated device may be reconfigurable to change the first position of the component relative to the frame.

In one form, the surface moves in translation as the arm moves in the controlled path.

In one form, the surface translates in a horizontal line as the arm moves in the controlled path.

The invention is further directed to the combination of a piano and a pedal actuating device. The piano has at least one operating pedal that is movable by a user from a starting position into an actuated position. The pedal actuating device has a frame, an arm on the frame and movable in a controlled path, and an actuator assembly. The frame is in an operative position relative to the piano. The actuator assembly has a component that is moved from a first position into a second position to thereby cause the one operating pedal to move from the starting position into the actuated position. The actuator assembly is configured so that movement of the arm in a first direction in at least a part of the controlled path causes the component to move from the first position into the second position. The arm is moved by a leg of the user situated in a playing position with respect to the piano by engaging a surface movable with the arm and moving the surface in a first direction in a predetermined path. The pedal actuating device is configured so that movement of the surface in the first direction in the predetermined path causes the generation of a force that is transmitted to the one component through at least one of: (a) a cable; and (b) a cooperating pair of gears.

In one form, the arm is movable around a vertical axis in the controlled path.

In one form, the component is a shaft that is guide in a substantially straight line between the first and second positions.

The invention is further directed to the pedal actuating device as described above.

The invention is still further directed to a method of playing a piano. The method includes the steps of obtaining the piano, as described above, and the pedal actuating device, as described above, with the frame in the operative position. The user assumes a playing position. The user plays the piano from the playing position including moving the one operating pedal from the starting position into the actuating position by engaging the surface with an inner thigh region and through movement of the inner thigh region moving the surface in the first direction in the predetermined path.

These and other features of the present invention will become readily apparent upon further review of the following specification and drawings.

BRIEF DESCRIPTION OF THE DRAWINGS

FIGS. 10-12 are schematic depictions of alternative configurations of the actuator assembly, as shown in FIG. 4.

FIG. 13 is a schematic representation of a connection between the arm and frame, as shown on the pedal actuating device in FIG. 4.

Similar reference characters denote corresponding features consistently throughout the attached drawings.

DETAILED DESCRIPTION OF THE PREFERRED EMBODIMENTS

Figure 1:
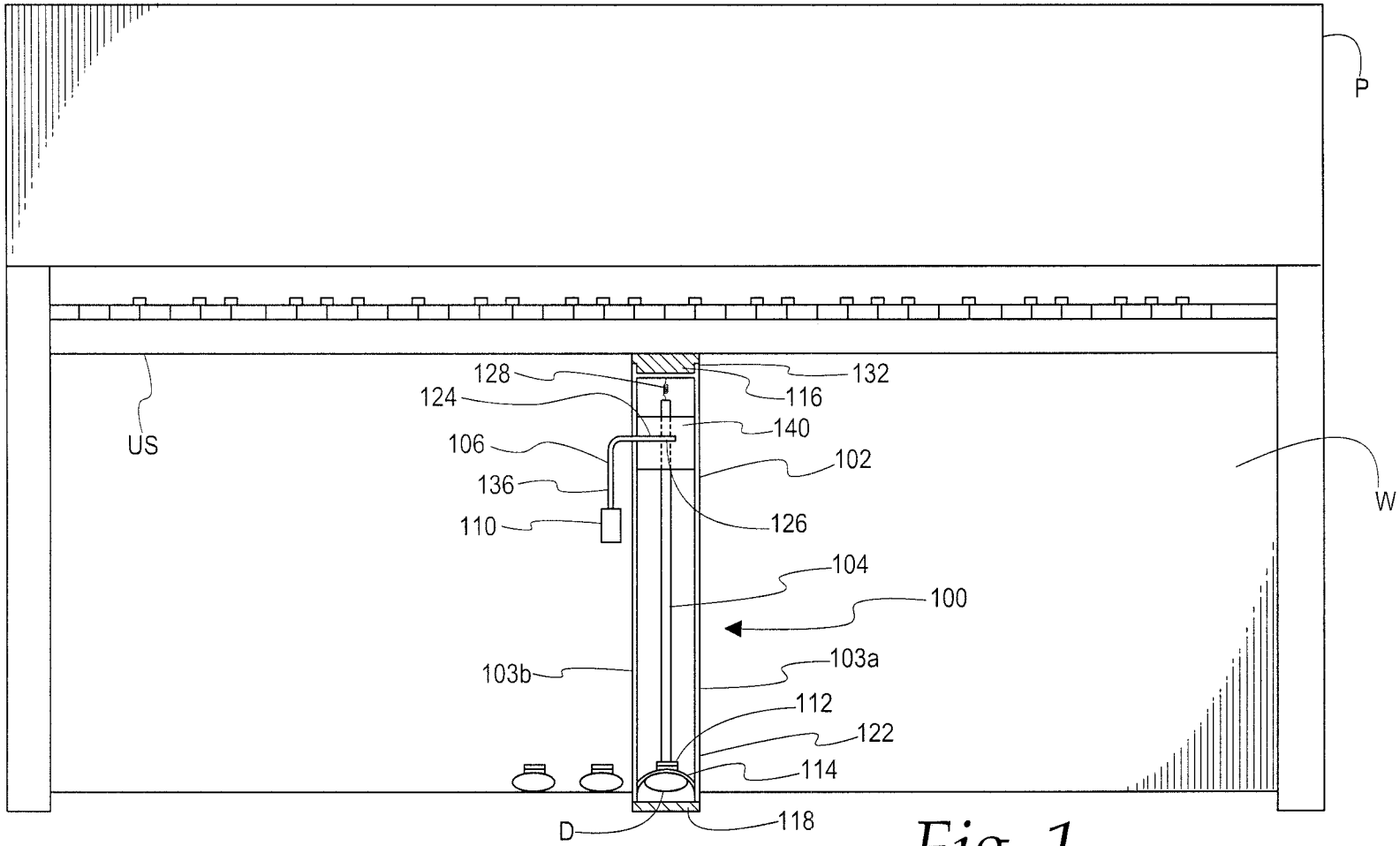
FIG. 1 is an environmental front, sectional view of a piano pedal actuating/depressing device, in accordance with the present invention, operatively connected to a conventional piano.

Referring now to FIG. 1, there is shown a piano pedal actuating/depressing device configured for connection to a piano P, generally referred to as 100. The piano pedal depressing device 100 permits a user to depress a piano pedal D (such as a damper pedal) located at the base of the piano P, using his or her upper leg portion. The piano pedal depressing device 100 includes an adjustable support housing 102, an actuating swivel arm 136, and an actuator assembly 120, which are operatively connected to each other, in order to facilitate depressing the pedal D.

Figure 2:
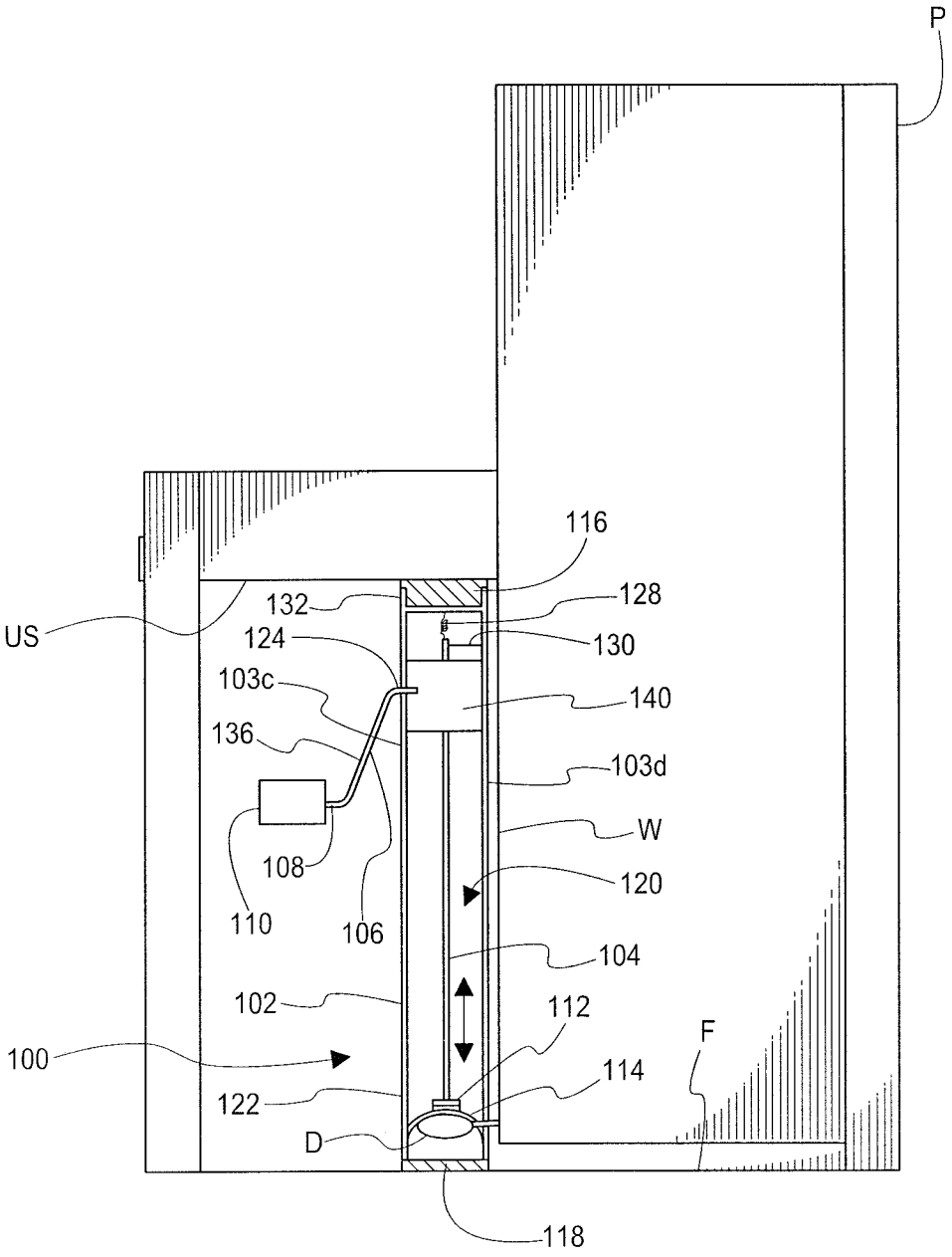
FIG. 2 is a side sectional view of the piano pedal depressing device of FIG. 1, operatively connected to a conventional piano.

The piano pedal depressing device 100 has a generally elongate body, adapted for being removably positioned between an undersurface US of the piano keyboard portion and a floor, or horizontal support surface. As illustrated in FIGS. 1 and 2, the support housing 102 includes a plurality of sidewall members 103*a*, 103*b*, 103*c* and 103*d* forming the body of the support housing 102, a base member 118, and a compressible member 116.

As illustrated, the compressible member 116 is provided generally at a first or proximal end 132 of the support housing 102, and is configured to engage the underside portion US of the piano's keyboard. The base 118 is provided generally at an opposite distal end 122 of the support housing 102, and configured to engage the floor F or surface upon which the piano is positioned. The compressible member 116 may include a resilient pad and/or a biasing member, such as a spring loaded pressure system, which can be compressed to accommodate a wide variety of conventional pianos having various distances between the piano underside US and the floor.

The base 118 may include a shock absorbent member, such as a rubber pad, to absorb pressure created when using the device 100, and to stabilize the piano pedal depressing device 100 on the floor. As illustrated, the base 118 may have an arcuate shaped portion 114 with a gap or opening configured to receive the pedal D therein.

The actuator assembly 120 includes a dowel rod or shaft 104, that extends substantially along the length of the housing 102. In an embodiment, the actuator assembly 120 further includes a biasing spring 128 and a pivot arm 130 that are connected to the shaft 104. The shaft 104 is configured to provide reciprocating upward and downward movement within the support housing 102. The pivot arm 130, connected to wall 103*d*, is configured to selectively pivot up and down to facilitate the downward and upward vertical movement of the shaft 104. A lower end of the shaft 104 includes an adjustable member 112 that can be vertically adjusted to lengthen or shorten the shaft 104. It is to be understood that the adjustable member 112 can be padded (e.g., rubber padded) to prevent, such as substantially prevent, the adjustable member 112 from either sliding off of the pedal D or from making a clicking sound once the adjustable member 112 is lowered against the pedal D.

In an embodiment, the swivel arm 136 can be connected to a rack and pinion assembly 140 of the actuator assembly 120. The rack and pinion assembly 140 can include a gear member 144 supported by a shaft 148 and a spring member 146. A rack 142 is fixedly connected to the shaft 104. The rack 142 has a plurality of gear teeth 152 configured to engage the gear member 144. A spring 146 is connected to the gear member 144. A second shaft member 150 can be provided to support a portion of the swivel arm 136 within the assembly 140.

The swivel arm 136 can have a first lateral portion 124, a second lateral portion 108, and a generally angled portion 106 that extends between the first lateral portion 124 and the second lateral portion 108. The second lateral portion 108 can be configured to have an adjustable length to accommodate a variety of individuals. The second lateral portion 108 can be formed from telescoping members, for example. The first lateral portion 124 extends within the housing 102. A connecting member 126 is positioned between the gear member 144 and the first lateral portion 124 of the swivel arm 136. The second lateral portion 108 and the generally angled portion 106 extend outside of the housing 102. A pad or cushion member 110 can be formed generally at the end of the second lateral portion 108.

Figure 3:
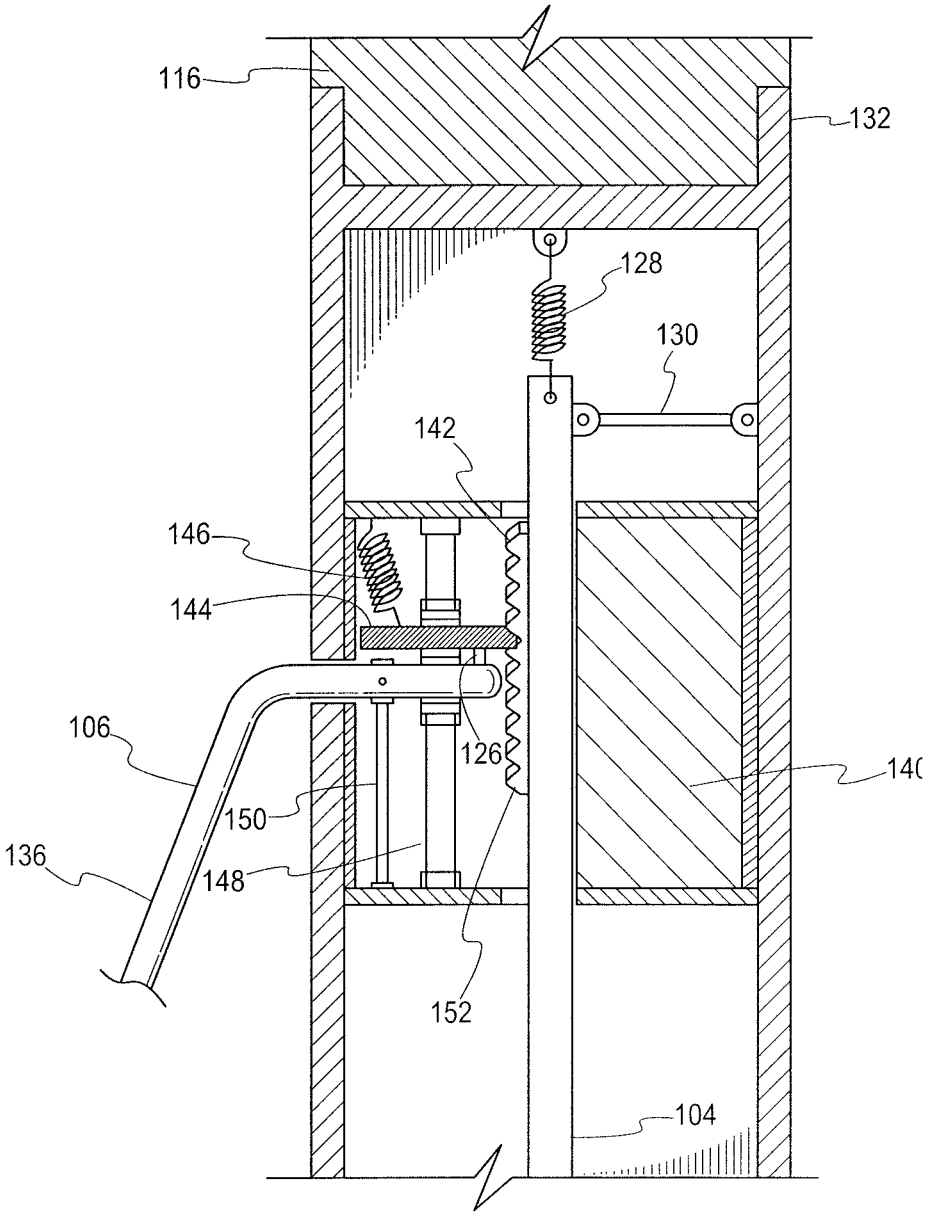
FIG. 3 is an enlarged, sectional view of an exemplary rack and pinion assembly for controlling movement of components of the piano pedal depressing device.

The swivel arm 136 is adapted to move in a generally radial direction relative to the shaft 104, when pressed by the user's upper leg. The pad member 110 provides a soft surface against which the user may press his or her upper leg to move the swivel arm 136. For example, movement of the swivel arm 136 can be configured to adjust the position of the gear member 144 in the rack 142 described above. The spring 146 can bias the gear member 144 in an opposing direction than that of actuation. Upon movement of the swivel arm 136 by the user, the shaft 104 is moved to an engaged position. When the swivel arm 136 is released by the user, the pedal member D provides a biasing force to move the shaft 104 up, back to an unengaged or start position. The rack and pinion assembly 140 converts rotational movement of the swivel arm 136 into vertical movement of the shaft 104, as illustrated in FIG. 3. Thus, the swivel arm 136 can be rotated to move the shaft 104 downward inside the support housing 102 and engage the pedal D. It should be understood that while a rack and pinion assembly has been described, the actuator assembly may include any suitable structure to convert rotational movement of the swivel arm into vertical movement of the shaft.

In operation, the user attaches the piano pedal depressing device 100 to the piano P by aligning the base of the piano pedal depressing device over the pedal D and positioning the compressible member 116 against the underside of the piano P. The piano pedal depressing device 100 is positioned such that the shaft 104 is aligned vertically with the pedal D. A user can press against the pad 110 of the swivel arm with his or her leg, e.g., inner leg, to cause rotation of the swivel arm 136 and, thereby, rotation of the gear member 144. Movement of the gear member 144 allows the shaft 104 to move in a downward direction. The shaft 104 moves downward, engaging the pedal D. Release of the swivel arm 136 permits the biasing force of the pedal D to force the shaft 104, and swivel arm 136 back to an unengaged starting position.

Figure 4:
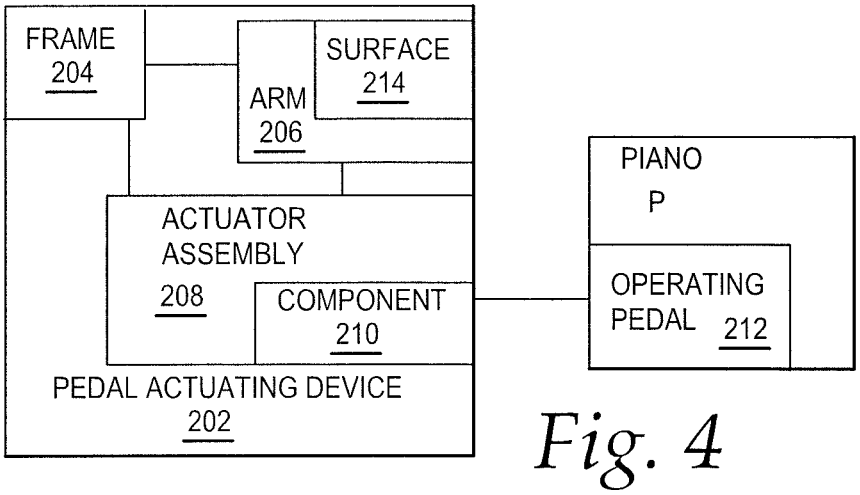
FIG. 4 is a schematic representation of the combination of a conventional piano and a pedal actuating device, according to the invention.

FIG. 4 is a schematic depiction of a piano pedal actuating device 202 according to the invention. The pedal actuating device 202, as generically depicted, incorporates the aforementioned constructions of the pedal actuating/depressing device 100, and variations thereof including, but not limited to, those described below.

Figure 5:
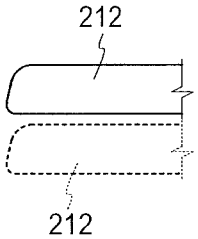
FIG. 5 is a schematic representation of an operating pedal on the piano in FIG. 4 shown as moved between a starting position and an actuated position.

The pedal actuating device 202 has a frame 204 with an actuating arm 206 on the frame movable in a controlled path relative thereto. The pedal actuating device 202 further includes an actuator assembly 208 having a component 210 that is moved from a first position into a second position to thereby cause an operating pedal 212 on the piano P to move from a starting position into an actuated position. For example, the operating pedal 212 may be the damper pedal that is depressed to move from a solid line/first position in FIG. 5 to the dotted line/second position therein.

Figure 6:
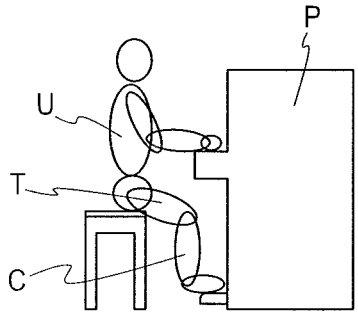
FIG. 6 is a schematic representation of a user in a playing position on a conventional piano from a side perspective.
Figure 7:
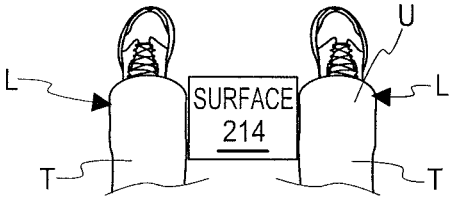
FIG. 7 is a schematic, overhead representation of the engagement between a user's legs and the surface on the inventive pedal actuating device in FIG. 4.

The actuator assembly 208 is configured so that movement of the arm 206 in a first direction in at least a part of the controlled path causes the component 210 to move from its first position into its second position. A surface 214, that is part of the arm 206, or separate therefrom and movable together therewith, is engageable by a user playing the piano P. More particularly, with the user U in a conventional playing position, as shown in FIGS. 6 and 7, in front of the piano, and the frame 204 in an operative position, the user U can engage the surface 214 with his/her legs, preferably at a region between the calf C and thigh whereby the leg L can be moved to reposition the surface 214 and the arm 206.

It is contemplated that the pedal actuated device 202 can be situated to allow either leg of a user to reposition the surface 214 to operate the piano pedal 212. In a preferred form, the inner thigh region is in contact with the surface 214 whereby a user can comfortably exert a substantial force on the surface 214 to operate the pedal 212.

It should be understood that the invention will be described herein with respect to operation of the pedal 212 with a user's right leg and inner thigh region. However, with the basic teachings herein, the pedal actuating device 202 can be reconfigured to be operated with either leg, on either the inside or outside thereof, to effect pedal operation.

Figure 8:
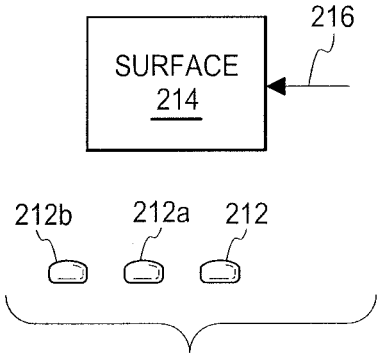
FIG. 8 is a schematic, front elevation view of the user engaging surface, on the inventive pedal actuating device in FIG. 4, in relation to a conventional piano.

As shown in FIG. 8, the general location of the surface 214 is in the region above the operating pedal 212 such that with a user in the playing position, the inner thigh of the user's right leg can be shifted comfortably to exert a force in the direction of the arrow 216 against the surface 214 to effect pedal operation.

Of course, the same inventive concept can be used to control operating pedals 212*a*, 212*b*, shown also in FIG. 8.

Figure 9:
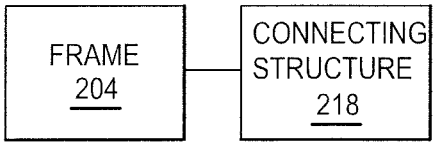
FIG. 9 is a schematic representation of connecting structure for maintaining the frame in FIG. 4 in its operative position.
Figure 14:
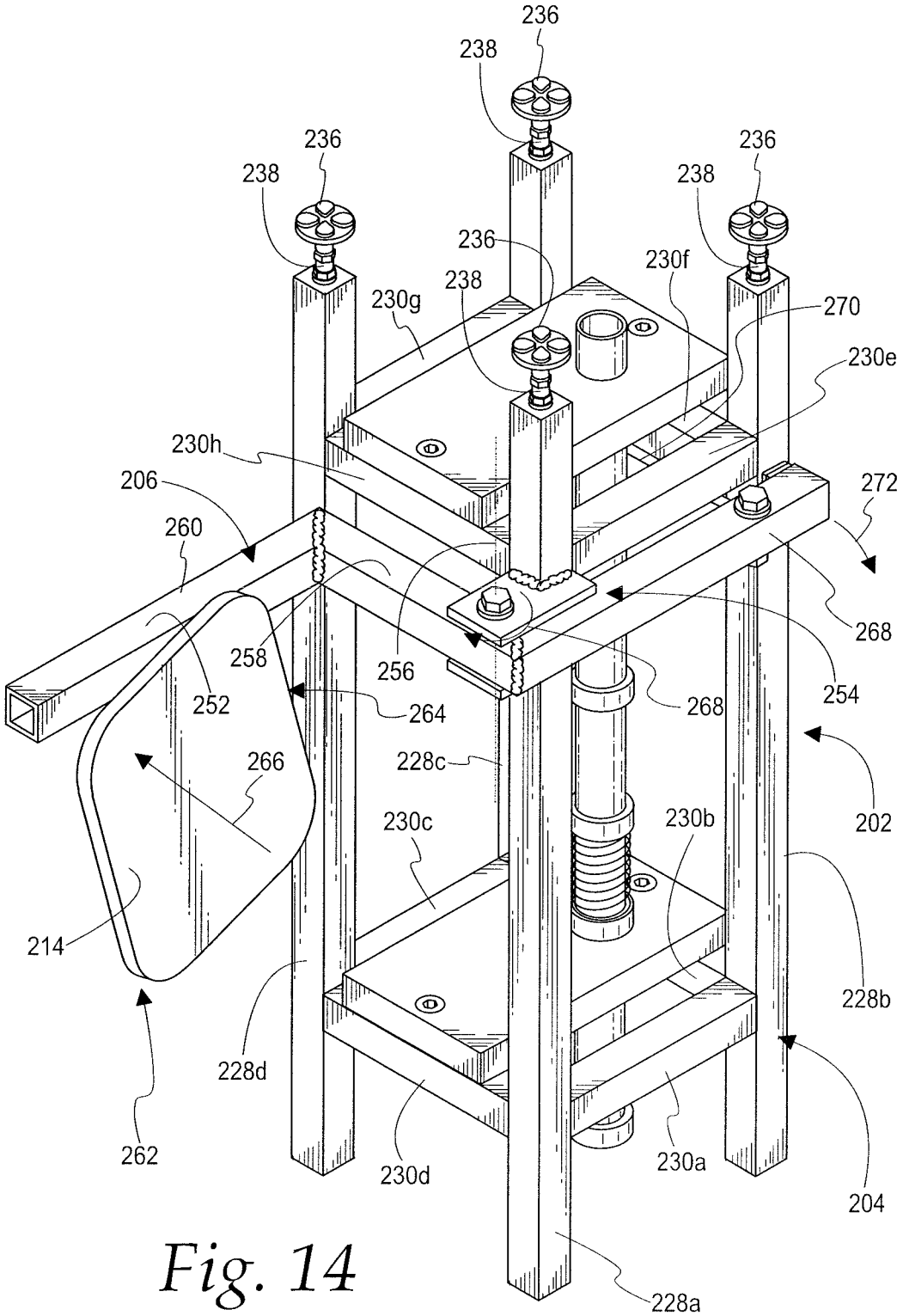
FIG. 14 is a perspective view of one specific form of the pedal actuating device as shown in FIG. 4.
Figure 15:
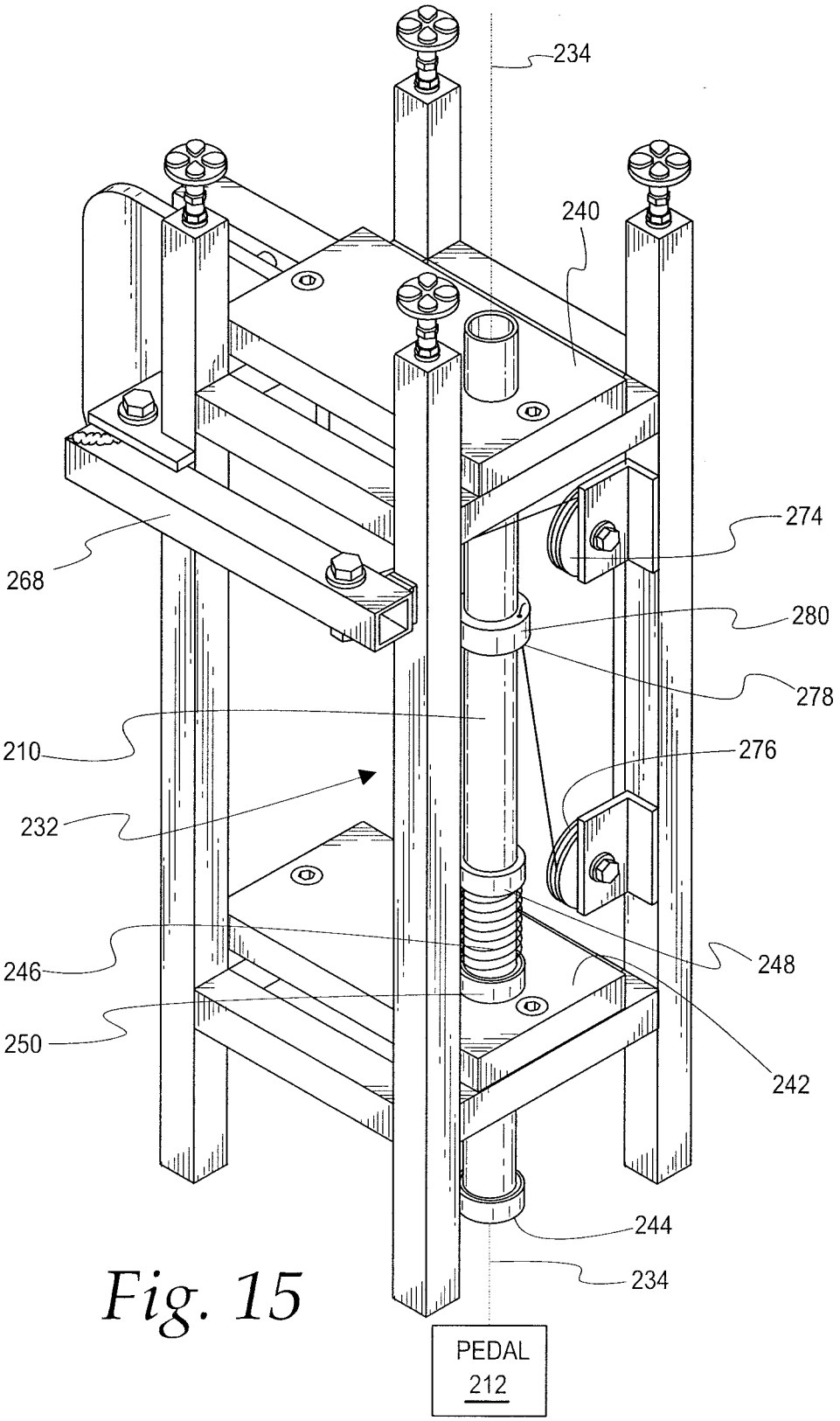
FIG. 15 is a view as in FIG. 14 from a different perspective.
Figure 16:
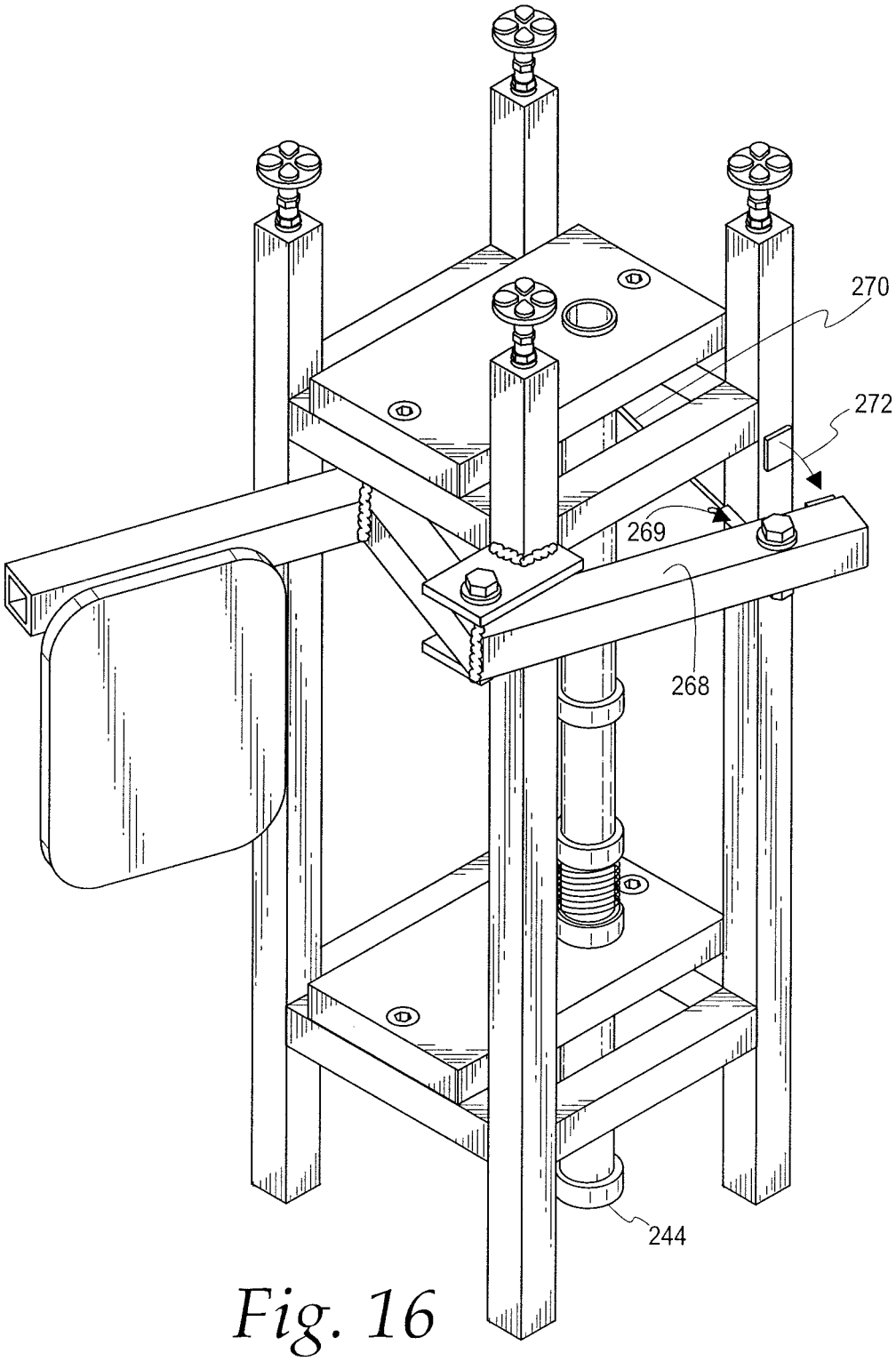
FIG. 16 is a fragmentary, perspective view of a portion of the pedal actuating device in FIGS. 14 and 15 with the actuating arm changed from its position in FIGS. 14 and 15.
Figure 17:
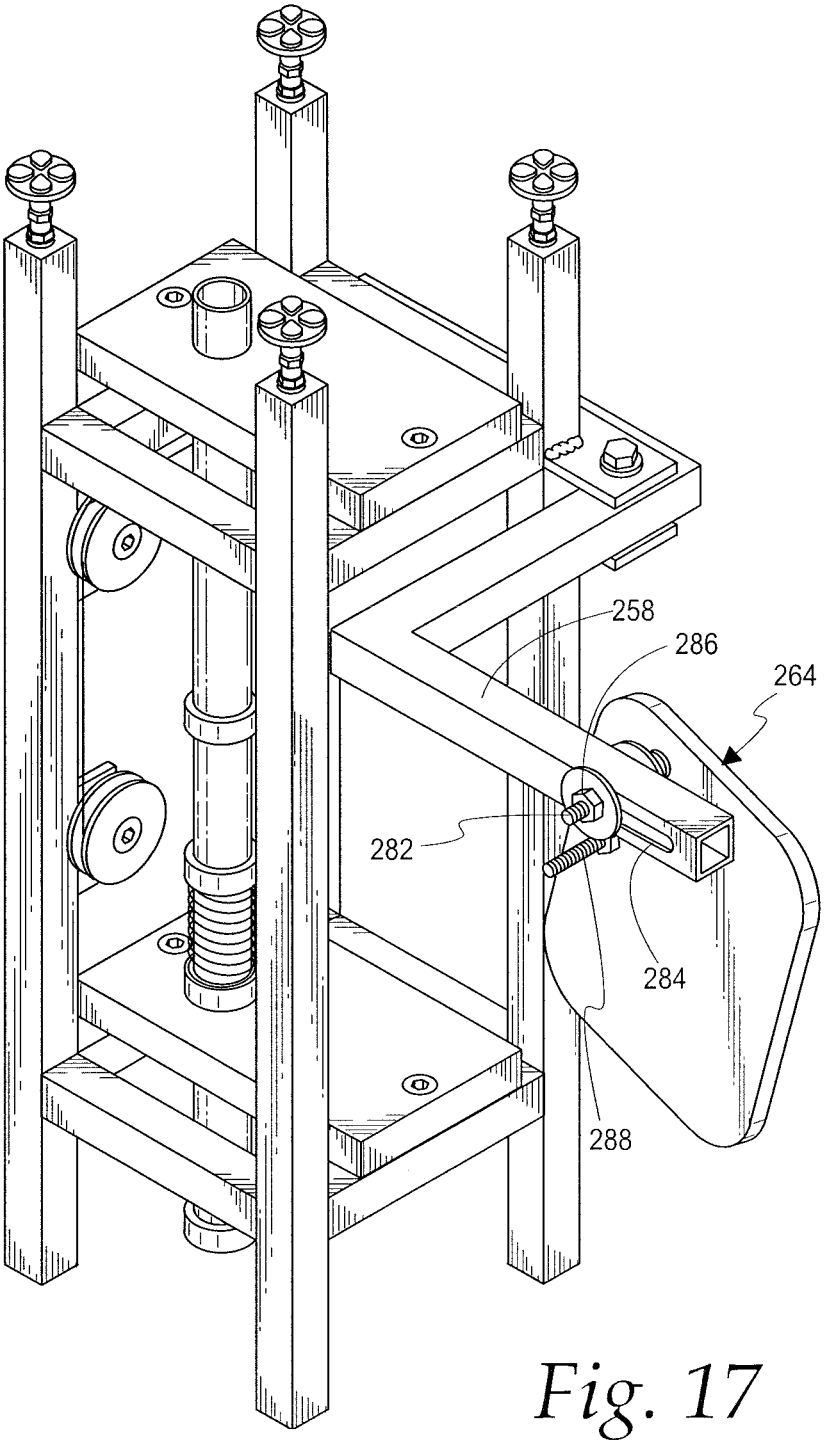
FIG. 17 is a view as in FIGS. 14 and 15 and from a different perspective.
Figure 18:
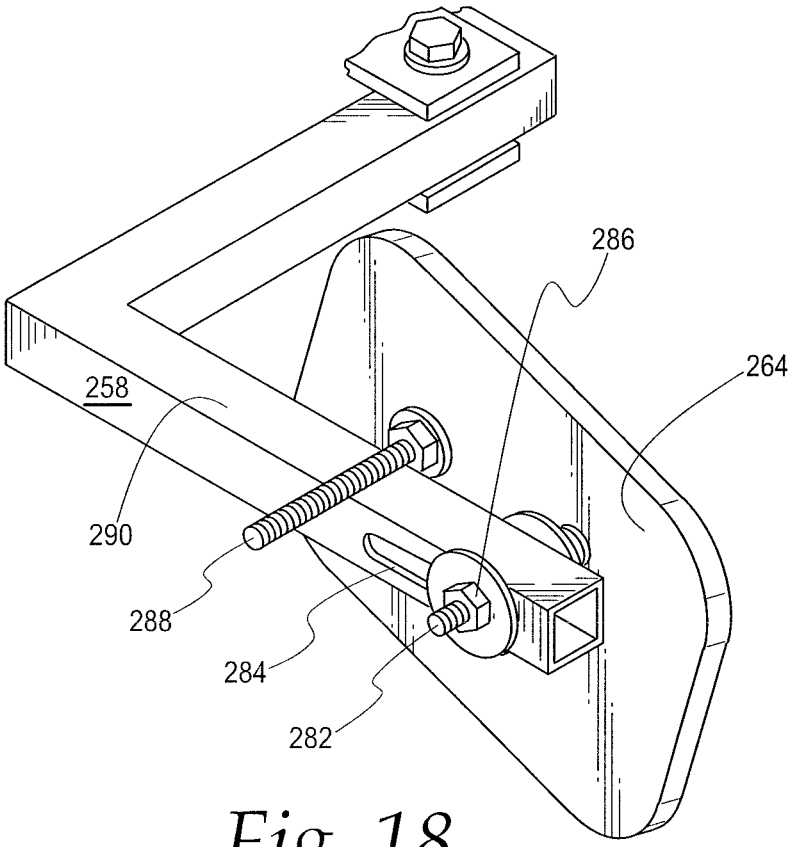
FIG. 18 is an enlarged, perspective view of a user engagement assembly through which a force is exerted by a user upon the actuating arm.

As shown schematically in FIG. 9, the frame 204 has an associated connecting structure 218 through which it can be maintained in its operative position in any of a number of different ways. For example, the connecting structure 218 may secure the frame 24 fixedly to the piano P. Alternatively, the connecting structure 218 may maintain the frame 24 stably on a subjacent surface. As described in the earlier embodiments, the connecting structure 218 may cooperate between the piano P and a subjacent surface or another structure to produce a captive stabilizing arrangement. All different types of connecting structure 218 for the frame 24, to maintain the frame 24 in its operative position, are contemplated within the schematic depiction of FIG. 9.

The actuating assembly 208 may be made using several different types of mechanisms that may be manually driven and/or may incorporate one or more powered components.

In FIG. 10, the actuator assembly 208 is shown with at least one cable 220 that transmits a moving force from the arm 206 to the component 210.

In FIG. 11, the actuator assembly 208' utilizes cooperating gears 222, such as, but not limited to, those described in the prior embodiment. The gears 222 transmit moving forces between the arm 206 and the component 210.

In FIG. 12, a power drive 224 is incorporated into the actuator assembly 208" to respond to movement of the arm 206 to generate a force to reposition the component 210.

Combinations of the components shown in FIGS. 10-12, and others, are contemplated within the schematic showing in the figures. For example, an actuator assembly may use gears and/or cables and/or powered components.

As shown schematically in FIG. 13, a connection 226 for the arm 206 may allow the arm 206 to move in different manners relative to the frame 204. For example, the generic showing of the connection 226 encompasses a translational movement of the arm 206 relative to the frame 204, as in a straight line, pivoting movement, etc.

Before describing one further exemplary embodiment in detail, it should be emphasized that all of the schematic depictions in FIGS. 4-13 are intended to encompass the specific forms, as hereinafter described and described above, and virtually an unlimited number of different variations of the components and their interactions, as would be obvious to one skilled in the art with the present teachings in hand.

Referring now to FIGS. 14-19, the piano pedal actuating device 202 depicted therein has a frame 204 with four generally parallel, upright posts 228*a*, 228*b*, 228*c*, 228*d* secured together by horizontal braces 230*a*, 230*b*, 230*c*, 230*d*, 230*e*, 230*f*, 230*g*, 230*h* that maintain a rectangular parallelepiped outer shape surrounding an internal cuboid volume 232 within which the component 210 moves. In this embodiment, while not required, the component is in the form of an elongate shaft/rod mounted to the frame 204 so that its central axis 234 of the component 210 extends in a vertical direction through the volume 232.

The frame 204 can be placed in its operative position generally corresponding to that shown for the embodiment in FIGS. 1-3 and also in FIG. 8.

Like pads 236 are mounted at the top of each post 238*a*, 238*b*, 238*c*, 238*d* to engage the underside US of the piano P, as in the embodiment in FIGS. 1-3. The pads 236 are each supported on an adjustable stem 238 using conventional components that allow the degree of projection of the pads 236 to be varied to thereby effectively change the height dimension of the frame 204 to accommodate different piano designs/dimensions. The pads 236 are mounted to swivel to allow conformity to the underside surface US on the piano.

With the frame in its operative position, the axis 234 of the component 210 resides over the pedal 212.

Upper and lower guide plates 240, 242, respectively, guide vertical translational movement of the component 210 from a first position, wherein a free end 244 rests against or is slightly above the pedal 212, and a second position wherein the free end 244 is advanced to move the operating pedal 212 from its starting position into its actuating position. The free end 244 may be made with an appropriate shape and material to positively transmit a moving force to the pedal 212 without generating noise.

In this embodiment, the component 210 is consistently maintained in the first position by a bias force produced by a coil spring 246. The coil spring 246 acts between a collar 248, fixed to the component 210, and a bearing element 250 on the lower guide plate 242. This arrangement may maintain the frame 244 slightly above the pedal 212 or in contact therewith.

Alternatively, the first position for the component 210 can be maintained by the pedal 212, which is normally spring biased to its starting position. The spring force generated by the pedal 212 may be adequate to support the weight of the component 210.

In this embodiment, the arm 206 has a main body 252 with an L-shaped portion 254 that is joined to the frame 204 for pivoting movement about a vertically extending axis 256. A first leg 258 of the "L" has a cantilevered extension 260 that supports a user engagement assembly 262. The user engagement assembly defines the aforementioned surface 214.

In this embodiment, the surface 214 is defined by a pad 264 with the surface 214. While not required, the surface 214 is generally flat and faces generally horizontally. The surface 214 may be defined by a cushioning material that may be comfortably contacted by a user.

The extension 260 provides a moment arm of significant length between the pivot axis 256 and the surface 214, whereby a user can press upon the surface 214 generally horizontally in the direction of the arrow 266 to effect pivoting of the main body 252 in the direction of the arrow 268 around the axis 256.

In this embodiment, the movement of the main body 252 around the axis 256 causes the second leg 268 of the "L" to draw an end 269 of a cable 270 generally in the direction of the arrow 272.

In this embodiment, the actuator assembly 208 utilizes two separate pulleys 274, 276 to reroute the cable 270 to allow a downward force to be generated thereby on the component 210.

More specifically, the cable extends from the leg 268 to the pulley 274, wraps through an arc therearound, and extends to the pulley 276 which it wraps around through approximately 180°. The opposite cable end 278 is fixed to a collar 280 on the component 210. With this arrangement, pressing the pad 264 in the direction of the arrow 266 causes the leg 268 to move in the direction of the arrow 272, which tensions the cable 270, thereby causing the cable end 278 to draw downwardly on the collar 280, compressing the spring 246 and advancing the free end 244 of the component 210 against the pedal 212 to change the same from the starting position into the actuated position. The arm 206 is moved in a controlled path in a first direction from the FIG. 14/first position into the FIG. 16/second position.

It should be emphasized that many different cable arrangements might be devised to transmit the force from the arm 206, as it is moved from the first position into the second position, to the component 210. Designs may utilize a single pulley, or more than two pulleys, to control cable path.

It should also be emphasized that the particular manner of maintaining the frame 204 in its operative position is not limited to that depicted. The depicted arrangement is desirable from the standpoint that the frame 204 can be shifted for alignment to a certain degree laterally in a fore and aft direction relative to the piano P while at the same time allowing the pads 236 to be extended upwardly to produce a compressive captive force between the piano and the subjacent surface upon which the frame 204 is supported in a straddling relationship with the pedal 212.

The coil spring 246 and/or the vertical position of the collar 248 can be changed to alter the resting position for the free end 244 of the component 210. The collar 280 can be moved to make a corresponding adjustment of the cable 270 to maintain a constant tensioned state regardless of the position of the free end 244.

Additional flexibility is afforded by making the surface 214 movable relative to the frame 204. In the depicted embodiment, the pad 264 is mounted to the leg 258 by a cantilevered, threaded post 282 extended through an elongate slot 284 on the leg 258. The pad 264 can be pivoted around the axis of the post 282 and maintained in a desired orientation by tightening a threaded nut 286 on the post 282. The post 282, apart from allowing pivoting around its axis, is slidably within the slot 284.

A stabilizing post 288 projects from the pad 264 at a location spaced from the post 286 and can be used to bear on an upper surface 290 of the leg 258. This more positively maintains a fixed orientation of the pad 264 and at the same time allows shifting of the post 282 within the slot 284.

While not required, in the embodiment depicted, the surface 214 is moved in a path that is substantially parallel to a horizontal reference plane. This allows a user to exert a substantial force as with his or her thigh or knee region with a natural side shifting of that particular limb area. Shifting the surface vertically might also otherwise cause binding, as with the user's clothes, which could impair operation.

As noted above, the actuator assembly might also be configured to allow the surface 214 to translate in a path, such as a straight line lateral path, in operation.

Figure 19:
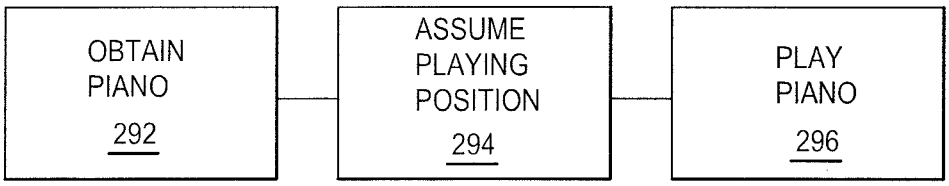
FIG. 19 is a flow diagram representation of a method of playing a piano, according to the invention.

With the structures as describe above, a method of playing a piano, according to the invention, can be carried out as described in flow diagram form in FIG. 19.

As shown at block 292, a piano is obtained with a pedal actuating device, as describe above, with the frame thereon in its operative position.

As shown at block 294, the player assumes a playing position.

As shown at block 296, the user plays the piano from the playing position, including moving the one operating pedal from the starting position into the actuating position by engaging the surface with an inner thigh region and through movement of the inner thigh region moving the surface in the first direction in a predetermined path.

It is to be understood that the present invention is not limited to the embodiments described above, but encompasses any and all embodiments within the scope of the following claims.

The invention claimed is:

1. In combination:

a piano having at least one operating pedal that is movable by a user from a starting position into an actuated position; and a pedal actuating device comprising:

a frame;

an arm on the frame and movable in a controlled path; and an actuator assembly, the frame in an operative position relative to the piano, the actuator assembly comprising a component that is moved from a first position into a second position to thereby cause the one operating pedal to move from the starting position into the actuated position, the actuator assembly configured so that movement of the arm in a first direction in at least a part of the controlled path causes the component to move from the first position into the second position, wherein the arm is movable by a leg of a user situated in a playing position with respect to the piano by engaging a surface movable with the arm and moving the surface in a path that is substantially parallel to a horizontal reference plane.

2. The combination according to claim 1 wherein the arm is moved around a vertical axis in the controlled path.

3. The combination according to claim 1 wherein the component is a shaft that is guided in a substantially straight line between the first and second positions.

4. The combination according to claim 1 wherein the arm comprises a main body and a user engagement assembly defining the surface, and the user engagement assembly is repositionable relative to the main body to allow the surface to be repositioned relative to the main body to allow the surface to be repositioned relative to a user in a playing position.

5. The combination according to claim 1 wherein the frame in the operative position is stabilized directly against the piano.

6. The combination according to claim 1 wherein the frame in the operative position is maintained in the operative position independently of the piano.

7. The combination according to claim 1 wherein movement of the arm in the first direction in the at least part of the controlled path by a user generates a force that is transmitted to the component through at least one of: (a) a cable; and (b) a cooperating pair of gears.

8. The combination according to claim 1 wherein with the frame in the operative position the component is biased relative to the frame into the first position.

9. The combination according to claim 1 wherein with the frame in the operative position, the surface is situated to engage a user's body region between a user's calf and thigh with the user in a playing position with respect to the piano.

10. The combination according to claim 9 wherein with the frame in the operative position the surface is situated to engage a user's inner thigh on a user's right leg with the user in a playing position with respect to the piano.

11. The combination according to claim 1 wherein with the frame in the operative position the pedal actuating device is compressibly captively maintained against a part of the piano.

12. The combination according to claim 1 wherein the pedal actuating device is reconfigurable to change the first position of the component relative to the frame.

13. The combination according to claim 1 wherein the surface moves in translation as the arm moves in the controlled path.

14. The combination according to claim 13 wherein the surface translates in a horizontal line as the arm moves in the controlled path.

15. The pedal actuating device as recited in claim 1.

16. In combination:

a piano having at least one operating pedal that is movable by a user from a starting position into an actuated position; and a pedal actuating device comprising:

a frame;

an arm on the frame and movable in a controlled path; and an actuator assembly, the frame in an operative position relative to the piano, the actuator assembly comprising a component that is moved from a first position into a second position to thereby cause the one operating pedal to move from the starting position into the actuated position, the actuator assembly configured so that movement of the arm in a first direction in at least a part of the controlled path causes the component to move from the first position into the second position, wherein the arm is movable by a leg of a user situated in a playing position with respect to the piano by engaging a surface, movable with the arm, and moving the surface in a first direction in a predetermined path, the pedal actuating device configured so that movement of the surface in the first direction in the predetermined path causes the generation of a force that is transmitted to the component through at least one of: (a) a cable; and (b) a cooperating pair of gears.

17. The combination according to claim 16 wherein the arm is moved around a vertical axis in the controlled path.

18. The combination according to claim 16 wherein the component is a shaft that is guided in a substantially straight line between the first and second positions.

19. The pedal actuating device as recited in claim 16.

20. A method of playing a piano, the method comprising the steps of:

obtaining the piano of claim 1;

obtaining the pedal actuating device of claim 1 with the frame in the operative position;

assuming a playing position;

playing the piano from the playing position including moving the one operating pedal from the starting position into the actuated position by engaging the surface with an inner thigh region and through movement of the inner thigh region moving the surface in the first direction in the predetermined path.

* * * * *